United States Patent [19]

Ward

[11] 4,085,551

[45] Apr. 25, 1978

[54] GRINDING MACHINES

[76] Inventor: Maurice Miller Ward, April Cottage, Ringwood Road, Ferndown, Dorset, England

[21] Appl. No.: 711,786

[22] Filed: Aug. 5, 1976

[30] Foreign Application Priority Data

Aug. 8, 1975 United Kingdom ..... 33232/75

[51] Int. Cl.[2] ..... B24B 49/16

[52] U.S. Cl. ..... 51/165 R; 51/165.92; 51/289 R; 51/105 R

[58] Field of Search ..... 51/165.92, 165.9, 105 R, 51/281 R, 289 R

[56] References Cited

U.S. PATENT DOCUMENTS

| | | | |
|---|---|---|---|
| 2,558,943 | 7/1951 | Ellison | 51/165.9 X |
| 2,961,808 | 11/1960 | Dunigan | 51/165.92 |

*Primary Examiner*—Harold D. Whitehead

[57] ABSTRACT

A form grinding machine in which the grinding wheel is fed into a workpiece by a hydraulic creep feed control circuit. The workpiece is rotated at a very slow speed while being ground completely around its circumference. The hydraulic circuit includes a torque limiting dump valve, and the workpiece rotation is controlled by a torque limiting slipping clutch mechanism to prevent overloading when the grinding wheel has been completely fed in and the workpiece is still rotating.

11 Claims, 3 Drawing Figures

GRINDING MACHINES

BACKGROUND OF THE INVENTION

1. Field of the Invention

This invention relates to grinding machines of the type in which a support for holding a workpiece to be ground by a driven grinding wheel is mounted for rotation about its axis, for example during form grinding.

2. Brief Description of the Prior Art

When using a form grinding machine, it is important to ensure that the torque loading between the grinding wheel and the workpiece does not become too high. Too high a torque loading can cause damage or excessive wear to the grinding wheel, and/or a bad surface finish on the ground workpiece.

To control the torque loading, it has previously been known to limit the rate of feed of the grinding wheel into the workpiece. Thus, in so-called "creep-feed" grinding machines the grinding wheel is hydraulically fed into the workpiece at a very low rate and the control circuit for the hydraulic feed includes a dump valve to limit or stop the feed if the torque loading between the grinding wheel and the workpiece becomes excessive.

However, a stage will generally be reached at which the grinding wheel has been fed into the workpiece by the required maximum amount, but grinding must continue while the workpiece is rotated until it has been ground to the desired depth about its entire periphery. The creep feed control will have no effect on the torque loading during this period.

Previously control on the torque loading has been controlled by empirically determining a suitable rate of rotation of the workpiece support whether by an electric motor or by hand. However this cannot accurately take into account variations in the radial extent of the workpiece, the depth that the grinding wheel is into the workpiece, the shape that is being ground, irregularities in the workpiece, and certain other factors which affect the torque loading. Under manual operation, these can partially be accommodated, but much will depend on operator skill and moreover it is desirable to be able to carry out a completely automatic grinding operation.

SUMMARY OF THE INVENTION

Thus, according to one aspect of the invention there is provided a grinding machine including means for mounting a grinding wheel which is to be driven in use, and a support for holding a workpiece to be ground by said driven grinding wheel, said support being mounted for rotation about its axis, wherein means for rotating the said support includes torque limiting means for automatically limiting to a predtermined value the torque on said support about its axis during rotation in use.

Hence, the torque on a workpiece held in the support in use will likewise be limited. Once the optimum torque has been determined, bearing in mind for example the material to be ground and the material of the grinding wheel, it is possible to carry out whatever grinding operations are required without relying on operator skill to such a great extent as previously. Moreover transient increases in torque loading can be accommodated, and variations in the shape or size of the workpiece may automatically be taken into account. Preferably the torque limiting means is adjustable to various torque settings.

Conceivably, the support could be driven hydraulically, the torque limiting means comprising a dump-valve in the drive circuit. Preferably however, the torque limiter is a mechanical drive transmission device such as, for example, a slipping clutch mechanism. The drive for the support may then be supplied by any convenient means, e.g. an electric or hydraulic motor. A mechanical drive transmission device will in many circumstances give a faster response than a simple hydraulic control valve particularly since it is rotary motion which is being controlled. Hydraulic control might permit undesirable over-run.

Where it is intended that a workpiece is rotated for a predetermined number of revolutions once the required grinding depth has been reached, the means for rotating the support may include counting means for registering the number of revolutions. This could for example comprise a cam engagable with a micro-switch. With a mechanical drive transmission device, the cam could be integrally provided. Preferably, means for effecting relative movement between said grinding wheel and said support in use so as to bring said grinding wheel into contact with a surface of a workpiece which is to be ground, includes means for limiting the torque loading between said grinding wheel and workpiece by controlling the rate of said relative movement between said grinding wheel and workpiece.

Preferably the means for effecting relative movement includes a hydraulic operating circuit including a dump valve set to operate at a predetermined pressure. The circuit should be such that the rate of relative movement during grinding is very low, for example about one third of an inch per minute. However, to facilitate initial setting up, it should be possible to have a higher rate when required. Control over the rate of movement is preferably possible in opposite directions, to enable both internal and external grinding.

The means for mounting a grinding wheel preferably includes a support for both ends of the axis of the wheel. Thus the drive for the grinding wheel may be supplied to one side thereof, the other side being supported in a bearing in a steady arm. A suitable grinding wheel would be diamond or boron coated.

It is of advantage if the workpiece support is movable longitudinally and thus the support is preferably mounted on a worktable mounted for longitudinal movement — either manually or hydraulically. In this event, it simplifies matters if the relative motion between the grinding wheel and the support is effected by movement of the means for mounting the grinding wheel. Preferably the movement is in a horizontal direction rather than a vertical one.

Adjustable stops, either mechanical or electrical, are preferably provided to limit the extent of relative movement and thereby the depth of grinding to a predetermined value.

A grinding machine according to the invention is particularly suited to the grinding of forms in workpieces; however it will have other useful applications.

According to another aspect of the invention there is provided a workhead for a grinding machine in which a workpiece is to be ground by a driven grinding wheel and is to be rotated about its axis in use, said workhead including means for attachment to the worktable of a grinding machine, a support for a workpiece, said support being rotatable about its axis in use, rotary drive input means for said support, and a torque-limiting drive transmission device intermediate said rotary drive input means and said support.

BRIEF DESCRIPTION OF THE DRAWING

An embodiment of the invention will now be described by way of example and with reference to the accompanying drawings in which.

DESCRIPTION OF THE PREFERRED EMBODIMENT

Figure 1:
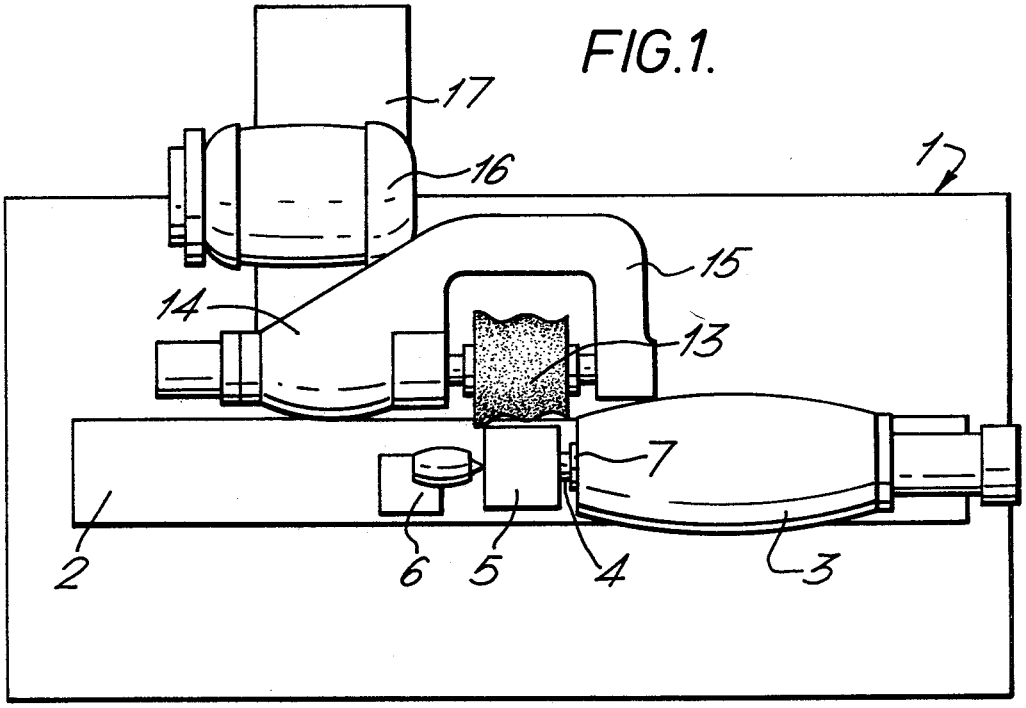
FIG. 1 is a diagrammatic plan view of a grinding machine according to the invention.

Referring now to the drawings, in FIG. 1 there is shown a grinding machine comprising a base 1, on which is mounted a work table 2. This table 2 is capable of longitudinal movement which may be either manually or hydraulically effected. A workhead 3 is mounted on table 2 and includes a support 4 for a workpiece to be ground, 5. Also on the table 2 is mounted an adjustable centre support 6 for the workpiece 5.

Figure 2:
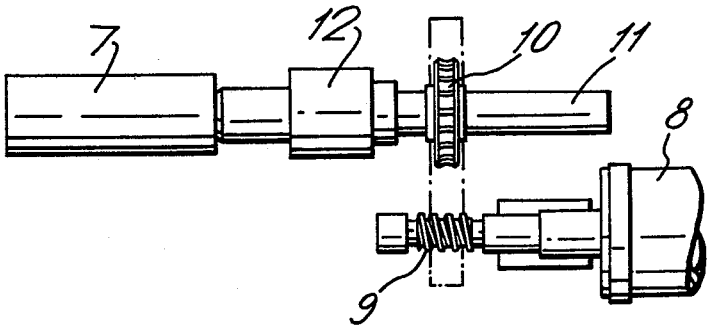
FIG. 2 is a detailed view of the workpiece support and associated drive mechanism.

As shown in FIG. 2, the workhead includes a spindle 7 with an internal taper for receiving the workpiece support 4. The spindle 7 is mounted for rotation about its axis by means of a hydraulic motor 8. The drive from the motor is transmitted via a first worm and wormwheel system 9, with a 20:1 speed reduction, and a second worm and wormwheel system 10, likewise with a 20:1 speed reduction.

The second worm and wormwheel system 10 drives an input shaft 11 and between the input shaft 11 and the spindle 7 is provided an adjustable mechanical torque limiter 12. In the present embodiment the torque limiter is one marketed under the name AUTOGARD model 204/1, and manufactured by GIB. PRECISION LTD, Barton Lane, Cirencester, Gloucestershire, England.

Referring again to FIG. 1, a form grinding wheel 13 is mounted on a wheelhead 14, which includes a steady arm or yoke 15 which supports the grinding wheel on either side. The wheelhead 14, and a motor 16 for driving the grinding wheel, are mounted on a slide 17. The slide 17 is capable of movement towards and away from the worktable 2, by means of a hydraulic control circuit.

Figure 3:
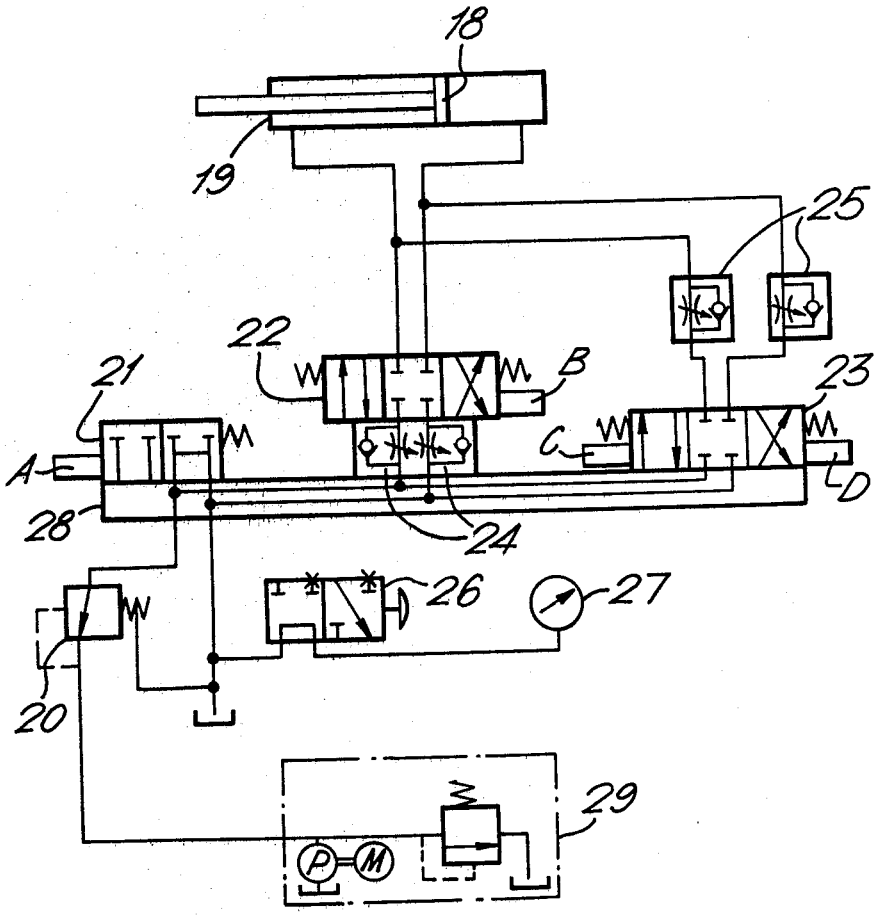
FIG. 3 is a hydraulic circuit diagram for the control of the feed of the grinding wheel into a workpiece.

Details of the control circuit are shown in FIG. 3. This circuit includes a power pack 29 including a motor M and a fixed displacement pump P together with a control valve. Hydraulic fluid is supplied via a dump valve 20 to a supply valve 21 operated by a solenoid A. The control circuit is operable to supply fluid to a double-acting hydraulic piston 18 in a cylinder 19 for effecting movement of the slide 17. Supply of fluid is either via directional control valve 22, operated by a double acting solenoid B, or via directional control valve 23 operated by solenoids C and D.

Flow control valves 24 are set so that control valve 22 gives a fast movement of the hydraulic piston 18, and flow control valves 25 so that control valve 23 gives a slow movement of the piston 18. A hand operated isolation valve 26 permits fluid pressure to be measured by gauge 27. The hydraulic connections between valves 21, 22 and 23 are all enclosed in a manifold 28.

In operation of the grinding machine, the grinding wheel 13 is set revolving at approximately 6–8,000 RPM. The workpiece 5 is also set revolving, but at a speed of approximately ½ RPM, motor 8 turning at about 20 RPM.

Solenoids A and B are then actuated so that the hydraulic piston 18 moves relatively rapidly in a direction such that the grinding wheel 13 moves towards the workpiece 5, i.e. to the left in FIG. 3. When the grinding wheel has almost reached the workpiece surface, which position may be defined by suitable stops (not shown), solenoids A and B are deactuated, and then solenoids A and D are actuated, so that the piston 18 continues to move to the left, but at a slower rate (i.e. the so-called "creep feed"), to carry out the grinding operation. This rate of feed may for example be one-third of an inch per minute. During this period of grinding, should the torque loading between the grinding wheel and the workpiece rise above a pre-determined value, dump valve 20 will operate to stop the feed of the grinding wheel.

When the grinding wheel has reached the required depth, which may for example be after the workpiece has rotated through 30°, automatic stops (not shown), which may be mechanical or electric, operate to prevent further feed of the grinding wheel, and solenoids A and D are de-actuated. The workpiece is then rotated further through one or more complete turns to complete the grinding process, the turns being counted by a cam and micro-switch arrangement (not shown). During this period of grinding, should the torque loading rise above a predetermined level, torque limiter 12, which has been adjusted to operate at this torque, stops rotation of the workpiece.

When grinding is complete, solenoids A and B are actuated once again (this time solenoid B operating in the reverse direction), to move the grinding wheel away from the workpiece at the faster rate, piston 18 moving to the right in FIG. 3.

The apparatus is also suitable for use in internal grinding, since solenoids A and C may be actuated to provide creep feed with piston 18 moving to the right in FIG. 3, i.e. outwardly with respect to the workpiece.

It will be appreciated that because of the manner in which excessive torque loading is avoided during all stages of grinding, the grinding process may be fully automated.

What I claim is:

1. A grinding machine comprising:
   - means for mounting a grinding tool;
   - means for driving a grinding tool installed on said mounting means;
   - spindle means for supporting a workpiece to be ground, said spindle means defining an axis about which a workpiece may be rotated;
   - means for rotating said spindle means about its axis, said spindle means rotating means including means for automatically limiting to a predetermined value the torque exerted on said spindle means during rotation; and
   - means for effecting relative linear movement between said grinding wheel mounting means and said spindle means so as to bring a grinding tool on said mounting means into contact with a rotating workpiece on said spindle means.

2. The grinding machine of claim 1 wherein said means for effecting linear movement between the grinding tool mounting means and spindle means includes:
   - means for restricting the rate of linear movement between the grinding tool mounting means and spindle means as a function of the torque loading between the grinding tool and the rotating workpiece during grinding when said linear movement is in progress.

3. The grinding machine of claim 2 wherein said means for restricting the rate of linear movement includes:

hydraulic actuator means, said actuator means including a piston;

means for supplying fluid under pressure to said hydraulic actuator to cause movement of the piston therein; and dump valve means for reducing the pressure of the fluid supplied to said hydraulic actuator to thereby vary the rate of relative movement in response to excessive torque loading between the grinding tool and the rotating workpiece.

4. The grinding machine of claim 3 wherein said means for supplying fluid to said hydraulic actuator comprises:

means defining a first hydraulic circuit for supplying fluid to the actuator at a first pressure to move the piston therein at a first rate to bring the workpiece and said grinding tool into contact;

means defining a second hydraulic circuit for supplying fluid to said actuator at a second lower pressure to move the piston at a second rate slower than said first rate when the grinding tool is in contact with the workpiece; and means for selectively coupling said first and second hydraulic circuit means to said actuator.

5. The grinding machine of claim 4 wherein said first and second hydraulic circuit means each control movement of said actuator piston in a pair of opposite directions.

6. The grinding machine of claim 1 wherein said means for rotating said spindle means comprises:

a drive motor, said motor having a rotatable output shaft;

transmission means for transmitting rotary drive from said motor output shaft to said spindle means; and a mechanical torque limiter in said transmission means.

7. The grinding machine of claim 6 wherein said mechanical torque limiter comprises:

a slipping clutch mechanism.

8. The grinding machine of claim 7 wherein said motor means comprises:

a hydraulic motor; and means for supplying fluid under pressure to said motor to effect rotation of said spindle means.

9. A grinding machine comprising:

means for mounting a grinding wheel;

means coupled to said mounting means for rotating a grinding wheel mounted thereon;

a spindle for supporting a workpiece to be ground, said spindle defining an axis about which the workpiece is to be rotated;

fluidic actuator means for effecting relative linear movement between said mounting means and said spindle whereby a grinding wheel installed on said mounting means may be urged into contact with a workpiece mounted on said spindle, said actuator means including a linearly movable piston;

means for supplying fluid under pressure to said actuator means to cause movement of the piston therein;

dump valve means coupled to said fluid supply means for reducing the fluid pressure in response to a predetermined torque loading between a grinding wheel and a workpiece during relative linear movement therebetween;

rotary drive means;

means transmitting rotary motion from said drive means to said spindle to cause rotation of said spindle about its axis; and torque limiting means in said rotary motion transmitting means whereby the torque exerted on said spindle will not exceed a predetermined level during rotation of said spindle.

10. The grinding machine of claim 9 wherein said torque limiting means comprises:

a slipping clutch.

11. A method for grinding a workpiece comprising the steps of:

rotating a grinding wheel at a high speed;

rotating a workpiece at a relatively low speed;

moving the rotating grinding wheel at a first rate of linear movement toward the rotating workpiece;

changing the rate of linear movement between the workpiece and grinding wheel to a second lower rate upon establishment of contact between the workpiece and grinding wheel to effect grinding;

controlling the second rate of linear movement in response to the torque loading between the grinding wheel and workpiece;

terminating the linear movement of the grinding wheel toward the workpiece when the desired depth of grinding has been achieved;

maintaining the relative position of the grinding wheel and workpiece at the desired grinding depth while continuing rotation of the workpiece for at least one revolution to complete grinding; and restricting the torque loading between the grinding wheel and workpiece during said continued rotation.

* * * * *